US010246842B2

(12) United States Patent
Van Reijen et al.

(10) Patent No.: US 10,246,842 B2
(45) Date of Patent: Apr. 2, 2019

(54) WATER BARRIER, IN PARTICULAR A DIKE

(71) Applicant: DESSO SPORTS B.V., PA Waalwijk (NL)

(72) Inventors: Peter Van Reijen, PA Waalwijk (NL); Jeroen Jozef Maria De Bruijn, PA Waalwijk (NL)

(73) Assignee: DESSO SPORTS B.V., PA Waalwijk (NL)

( * ) Notice: Subject to any disclaimer, the term of this patent is extended or adjusted under 35 U.S.C. 154(b) by 103 days.

(21) Appl. No.: 15/516,341

(22) PCT Filed: Oct. 1, 2015

(86) PCT No.: PCT/NL2015/050687

§ 371 (c)(1),
(2) Date: Mar. 31, 2017

(87) PCT Pub. No.: WO2016/053102

PCT Pub. Date: Apr. 7, 2016

(65) Prior Publication Data

US 2017/0241091 A1 Aug. 24, 2017

(30) Foreign Application Priority Data

Oct. 1, 2014 (NL) ..... 2013553
Jun. 2, 2015 (NL) ..... 2014906

(51) Int. Cl.
*E02B 3/10* (2006.01)
*E02D 17/20* (2006.01)
*E02B 3/12* (2006.01)

(52) U.S. Cl.
CPC ..... *E02B 3/10* (2013.01); *E02B 3/12* (2013.01); *E02D 17/20* (2013.01); *E02D 2250/003* (2013.01); *E02D 2300/0051* (2013.01)

(58) Field of Classification Search
CPC ... E02B 3/10; E02B 3/12; E02D 17/20; E02D 2250/003; E02D 2300/0051
See application file for complete search history.

(56) References Cited

U.S. PATENT DOCUMENTS 6,029,397 A * 2/2000 Motz ..... E01C 13/083 47/58.1 R
6,035,577 A * 3/2000 Motz ..... A01G 20/20 47/58.1 R
6,524,027 B1 2/2003 Fabius

FOREIGN PATENT DOCUMENTS

FR 2006203 A1 12/1969
NL 9002244 A 5/1992

OTHER PUBLICATIONS

Golder Associates Ltd. et al., "Dike Design and Construction Guide: Best Management Practices for British Columbia," Jul. 2003, p. 1-5 and 30.*

(Continued)

*Primary Examiner* — Tara Mayo-Pinnock
(74) *Attorney, Agent, or Firm* — Casimir Jones, SC; Robert A. Goetz

(57) ABSTRACT

The present invention relates to a water barrier, in particular a dike, comprising an inner slope, a crown and an outer slope, wherein the outer slope is located on the waterside. The water barrier is characterized in that the natural vegetation of at least one of the elements of inner slope, crown and outer slope is provided with fibers inserted into said vegetation.

19 Claims, 2 Drawing Sheets

(56) References Cited

OTHER PUBLICATIONS

International Search Report and Written Opinion, International Patent Application No. PCT/NL2015/050687, dated Mar. 14, 2016.
International Preliminary Report on Patentability, International Patent Application No. PCT/NL2015/050687, dated Apr. 4, 2017, six pages.

* cited by examiner

WATER BARRIER, IN PARTICULAR A DIKE

The present invention relates to a water barrier, in particular a dike, comprising an inner slope, a crown and an outer slope, wherein the outer slope is located on the waterside.

Such dikes have been applied since time immemorial along for instance rivers or other flowing or non-flowing bodies of water with changing water level, this generally with success. At exceptionally high water level however, the dike can become unstable and fail. This can be the result of a rise in the water pressure in and under the dike. This has an adverse effect on the effective ground pressure, resulting in the loss of shear strength whereby the stability decreases. The dike can hereby crumble away and shift or fail along a deep sliding plane on the rear side (i.e. the side remote from the water to be retained, also referred to as stability zone). A dike breach can ensue. Grass present as natural vegetation forms in many cases an important part of civil engineering constructions such as dikes.

Because of global warming, particularly due to the emission of greenhouse gases, it is anticipated that the sea level will rise in the coming decades. This means that in determined regions existing dikes will have to be modified. Particularly in the Netherlands, a part of which is below water level, the problem of dikes (which are too low) has been placed high on the agenda of the Dutch government.

In order to combat the effect of exceptionally high water levels dikes are traditionally reinforced or strengthened, for instance by placing a stability berm and/or piping berm in the stability zone of the dike. Or by applying space-saving structural elements such as sheet piling, diaphragm walls and the like. When a dike does not have sufficient strength to withstand the pressure of the water, it can be strengthened by civil engineering operations. One way is by arranging an inner berm, such as in the case of a coastal dike. A dike can in addition be strengthened or a different material can be used for the covering layer. In the case of widening use is made of several materials such as clay grains, foam concrete, polystyrene foam and aeolian sand.

A recent development relates to a so-called 'JLD dike stabilizer', i.e. a plastic pin which strengthens dikes so that they once again meet safety requirements. A dike is strengthened on the inside by the stabilizer. The pin is inserted in a few minutes with a small machine and is made from a special type of flexible plastic.

On a dike itself a revetment is usually arranged. This revetment can be natural in the form of grass but can also consist of synthetic materials. Dikes are covered for various reasons, but the most important function of the revetment is to prevent erosion by wave overtopping. It moreover increases the watertightness. In addition, the revetment of a dike ensures that it can be used for other functions and can also result in limited maintenance. The revetment can also be a factor in the aesthetic perception of a dike, such as its integration into the landscape. Dikes which are not used/loaded intensively are in most cases covered with grass.

When the naturally present grass does not provide sufficient protection, use is made of other materials such as stones, rubble, asphalt, gabions and special synthetic mats (geotextile). The choice of material depends on, among other factors, the flood risk, type of dike, costs and appearance of the covering material. When one material does not perform the function adequately, a combination of materials can be used so that the dike fulfils its function.

It is further known that the stability of dikes can be undermined by the presence of particular animals such as moles. Moles dig underground tunnel systems which have an adverse effect on dike stability.

Known from the Netherlands patent publications NL 1023362 and NL 1003138 is an element for covering a bank or a dike. Further known from NL 1009578 is an implementation method for arranging sheeting or foil on a slope or dike.

FR 2006203 relates to a non-woven mat for consolidating embankments, dikes, canals and sports fields so as to prevent erosion, consisting of at least one layer of synthetic fibres chosen from polyamide fibres, polyester fibres and the polyolefin fibres, wherein the fibres together with a binder are welded and/or sewn or stitched together.

EP 0 554 330 relates to an artificial grass field consisting of a substructure and a top layer arranged thereon, wherein the top layer comprises fibres which are arranged regularly spaced from each other and which, when seen in the longitudinal direction of the fibre, extend deeper into the ground than they protrude above the ground, with natural grass seeded between the fibres in a nutrient medium on the substructure.

The U.S. Pat. No. 6,524,027 relates to a method of stabilizing the soil of a slope with an angle of inclination of less than 45 degrees, wherein a geosynthetic layer is arranged adjacently of the surface of the slope such that the vegetation is stabilized on the surface of the slope for the purpose of securing the soil adjacently of the surface of the slope.

An aspect of the present invention is to provide a water barrier, in particular a dike, wherein a reinforcement of the dike is brought about in efficient manner.

Another aspect of the present invention is to provide a water barrier, in particular a dike, wherein the effect of increasing stability is imparted to the naturally present vegetation.

The present invention thus relates to a water barrier, in particular a dike, comprising an inner slope, a crown and an outer slope, wherein the outer slope is located on the waterside, which water barrier is characterized in that the natural vegetation of at least one of the elements of inner slope, crown and outer slope is provided with fibres inserted into said vegetation.

The insertion of fibres has the result that one or more of the above stated objectives are fulfilled. The present inventors propose, without being in any way limited thereto, that the presence of fibres has a favourable effect on the strength and resistance of the naturally present grass. It is furthermore proposed that such fibres can result in an improvement in the anchoring of grass roots in the soil and in an improvement of the mutual intertwining of the grass roots. Because there is possibly also an improvement in the drainage capacity of the present water barrier, there will be a rapid discharge of surplus water, this enhancing the stability of the water barrier. And such an improvement in the drainage capacity would also have a favourable effect in respect of stimulating grass growth.

The fibres applied in the present invention must not be confused with (synthetic) fibres in a woven form, such as for instance in geotextile sheeting. In such sheeting the (synthetic) fibres are connected to each other, for instance as a result of a weaving technique, whereby the sheeting acquires the intended strength. The fibres as applied in the present invention can be deemed "individual" fibres which are not connected to each other as in a woven construction but are inserted as separate fibres into the ground. It is for instance possible in the present invention to arrange a fibre in the ground which is made up of one or more individual fibres, for instance a yarn composed of six fibres.

The fibres applied in the present invention are for instance inserted in a U-shape into the substrate, wherein the "closed part" of the U-shape is located in the substrate. The present application of fibres ensures that it is precisely this individual construction of the fibres which provides the natural vegetation with the possibility of mixing with the fibres, a mixing which with woven sheeting, whether or not provided with intermediate openings through which the natural vegetation can grow, cannot take place. In addition, the fibres applied in the present invention will be positioned more or less parallel to the natural vegetation, this positioning differing essentially from for instance a geotextile sheeting which is usually positioned perpendicularly of the direction of growth of the natural vegetation.

As suitable fibres can be mentioned fibres as disclosed in NL 1006606. In addition, EP 0 996 781 discloses a yarn suitable for the present invention, i.e. a yarn which comprises, as addition to polyamide, a polyolefin compound, chosen particularly from the group of polypropylene, LLDPE, and a block copolymer of polypropylene and polyethylene. It has however also been found possible to apply a yarn comprising one or more of a polyolefin compound, chosen particularly from the group of polypropylene, LLDPE, and a block copolymer of polypropylene and polyethylene. Fibres of the aramid or carbon type may be suitable in particular embodiments.

Functionalized fibres are also applied in addition to the above stated fibres, for instance biodegradable fibres. As possible examples can be mentioned: hemp fibre, jute, kapok, coconut fibre, sisal and flax. The above stated natural fibres can optionally be applied in combination with synthetic fibres.

In a particular embodiment of the present water barrier it is desirable that at least two of the elements of inner slope, crown and outer slope are provided with fibres inserted into said vegetation. A good stability of the water barrier is obtained in such a construction.

According to a particular embodiment, the fibres inserted into the vegetation are located under the surface of said vegetation. In such a construction animals such as sheep, cows for instance present in the vicinity of the water barrier cannot eat the inserted fibres.

It is however also possible for fibres inserted into said vegetation to extend to some extent above the surface of said vegetation.

If the fibres are inserted into the inner or outer slope, it is then desirable for the fibres to enclose an angle therewith, which angle amounts to less than 90°, preferably between 20° and 80°. It is also possible in specific embodiments for the fibres to be inserted substantially perpendicularly into the substrate. The term "substrate" should be understood to mean a dike, i.e. a dike comprising an inner slope, a crown and an outer slope.

It is desirable that said fibres are inserted to a depth of at least 10 cm, preferably at least 20 cm.

In a particular embodiment the fibres with a length of about 15-25 cm are arranged substantially perpendicularly relative to the substrate, wherein it is desirable that about 5 to 10% of the length of the fibres protrudes above ground level.

In a particular embodiment of the present water barrier the fibres are inserted in mutually adjacent rows, wherein the distance between the rows lies in the range of 10-50 mm, and wherein the mutual distance between fibres in such a row amounts to 10-50 mm. Such a pattern of fibres can be seen as a grid pattern, the sides of which lie between 10 and 50 mm.

It is also desirable in specific embodiments that the mutually adjacent rows are "offset". The fibres are inserted regular spaced from each other in the substrate, wherein this regular spacing can be obtained by arranging the fibres in a determined pattern, such as at the corner points of an imaginary equilateral triangle. The dimension of the sides of the equilateral triangle can be varied, wherein in the case of the larger dimension of the side fewer fibres per square meter of substrate are inserted into the ground. It is thus desirable in a particular embodiment of the present water barrier that the fibres are placed at the corner points of an imaginary equilateral triangle with sides of about 10-50 mm.

It is desirable in particular situations that the distance between the rows of fibres arranged in said outer slope differs from the distance between the rows of fibres arranged in said inner slope. A reinforcement can thus be realized at those positions where reinforcement is most desired.

The same construction occurs for instance when the rows of fibres arranged in at least one of inner slope, crown and outer slope are not spaced homogeneously. A local reinforcement is then realized.

The present invention further relates to a method for manufacturing a water barrier as specified above, wherein one or more fibres are inserted into the natural vegetation of at least one of the elements of inner slope, crown and outer slope.

In a particular embodiment the insertion of said fibres takes place by means of injection, wherein a pin is positioned in the natural vegetation while carrying along a fibre, after which said pin is taken out of said vegetation while leaving said fibre behind in the vegetation. As possible methods for such a manner of insertion can be mentioned: NL 9002244, NL 1007279, WO 9308332 and NL 1016193 in the name of the present applicant, which documents can be deemed as incorporated herein.

Although mention is made in the present description introduction of the insertion of fibres into the natural vegetation, it should also be apparent that the invention relates to a situation wherein a dike, which does not (yet) have natural vegetation, is first provided with fibres, after which the natural vegetation will form only later around the inserted fibres.

It is however desirable in particular situations for the insertion of said fibres to take place by forming an opening in said vegetation, after which the fibre is inserted into the thus formed opening.

The forming of the opening preferably takes place by means of a water jet and/or compressed air.

The forming of the opening preferably takes place by means of a drill.

In a particular embodiment the method for manufacturing a water barrier comprises a number of steps, wherein a pin movable up and downward in a substantially vertical direction in the substrate is applied for arranging the fibres in the natural vegetation, wherein the method comprises the following steps of:

i) providing an endless fibre, ii) connecting an outer end of said pin to the fibre as according to i), iii) moving the outer end of said pin connected to the fibre as according to ii) in vertical direction to a desired depth in the substrate, iv) removing said pin from the substrate while leaving the fibre behind in the substrate, v) connecting an outer end of said pin once again to the fibre as according to i), vi) moving the outer end of said pin connected to the fibre as according to v) in vertical direction to a desired depth in the substrate, wherein the position of the fibre arranged in the substrate as according to iii) differs from the position of the fibre arranged in the substrate as according to vi).

The insertion of fibres in this way has the result that one or more of the above stated aspects are addressed, in particular that the fibre which runs through the substrate serves to fix thereto the roots of the natural vegetation, in particular the grass, this imparting an additional reinforcement to both the grass and the fibres. The term "substrate" should be understood to mean a natural ground or a piece of land, for instance a grassland or field of grass, a dike body, arable land and the like, wherein a human activity can be carried out on the upper surface of the substrate, for instance travel with a vehicle, but also running and walking. The term "substrate" used here should in any case not be interpreted as a product, for instance an item of clothing. The term "vertical direction" must be understood to mean a direction which has the purpose of inserting the fibre into the substrate. Such a direction can therefore extend at a determined angle to the upper surface, but also substantially perpendicularly. The choice of the angle can also be adapted during performing of the present method in accordance with requirements. Although mention is made here of grass, the present invention is not limited to a specific type of dike vegetation. Usual dike vegetation consists for the greater part of different types of grass and in lesser part of diverse types of herb depending on, among other factors, the location relative to the sun (the south side of the dike is warmer and drier than the north side), and the composition of the soil, for instance clay or sand. The dike vegetation is important for the resistance of the dike to water erosion at high water levels and precipitation, and the dike must preferably have a dense sward with a deep rooting.

An aspect of a particular embodiment of the present method is that, particularly between step iv) and step v), a step of severing the fibre is not performed. Such an operation of severing the fibre forms in practice a large part of the time of installing the fibre construction. And because according to a particular embodiment of the present method use is made of an endless fibre, which is preferably supplied on a roll, the fibres arranged in the substrate will be connected to each other. The fibres will in particular be inserted into the substrate and the fibre will subsequently exit the substrate again and then be reinserted into the substrate. This has the result that a part of the fibre will come to lie over the upper surface. In such an embodiment there will therefore not be a situation as disclosed in the European patent EP 0 554 330 granted in the name of the present applicant in which the length of the fibre, i.e. the blades which protrude over a height of 1-1.5 cm above ground level, is such that the part protruding above the nutrient medium is held in place. In such a recommended embodiment the fibre will further be located as a kind of "loop" in the substrate. After all, a determined fibre length is arranged in the substrate in step iii), after which the fibre, because it is in fact an endless fibre here, will once again exit from the substrate, after which a desired number of steps ii)-vi) are performed again. The "loop" is thus situated in the substrate and, particularly at the position where the pin is guided into the substrate, there will be a length of fibre which "disappears" into the substrate and a length of fibre which "appears" from the substrate, wherein the length of fibre exiting the substrate can be reinserted as a fibre into the substrate, in particular at a position differing from the previous insertion of the fibre. The fibre arranged in the substrate thus "returns" at the deepest point in the substrate. It may be desirable in specific embodiments to vary such deepest points during the present method.

According to a particular embodiment of the present method, steps ii)-vi) are repeated such that the thus obtained positions of fibres arranged in the substrate can be deemed a row of fibres.

It is recommended here that steps ii)-vi) are repeated such that rows of fibres are obtained which are positioned regularly spaced from each other.

In addition to the above stated embodiment of mutually adjacent rows, wherein the fibres are as it were positioned as "pairs" in the mutually adjacent rows, it is also possible for the rows positioned regularly spaced from each other to be displaced relative to each other. This is therefore an embodiment wherein the fibres arranged in the substrate are as it were "offset".

Because in a particular embodiment the present method makes use of an endless fibre, which must be understood to mean a fibre which is supplied on for instance a roll or reel and is not cut or clipped into separate fibre lengths during the method, it is desirable that the fibre lying between fibres successively arranged vertically in the substrate lies against the upper surface of the substrate.

In order to ensure that the fibre is laid "tightly" over the upper surface, it is desirable that during at least one of the steps ii)-vi) a pressing member is applied in order to press the fibre lying against the upper surface against the upper surface. A suitable pressing member is for instance a pressure roller moving over the upper surface.

In order to ensure that the fibre is laid "tightly" over the upper surface, it is further desirable that during the repeated application of steps ii)-vi) the fibre is held under tension.

In a particular embodiment of the present method it is desirable that steps ii)-vi) are performed while applying a number of pins. A desired production capacity is thus achieved. It is also possible here that specific types of fibre are applied for specific pins so that a substrate is thus obtained in which a number of different types of fibre are arranged.

In a particular embodiment it is desirable that steps ii)-vi) are not performed simultaneously when a number of pins are applied. In such an embodiment the pins will have a different cycle or frequency.

In a particular embodiment it is desirable that steps ii)-vi) are performed simultaneously when a number of pins are applied, whereby a specific manner of insertion is in fact realized.

In order to improve the anchoring of the fibres arranged vertically in the substrate it is desirable in a specific embodiment that a mesh is applied, which mesh is positioned on the upper surface and connected to the fibres such that the fibres lying against the upper surface of the substrate enclose said mesh. As a suitable mesh can be mentioned for instance a grid, in particular a metal or plastic grid.

An example of a natural substrate is a water barrier, in particular a dike, comprising an inner slope, a crown and an outer slope, wherein the fibres are arranged particularly in at least one of the elements of inner slope, crown and outer slope. Although mention is made in the present description introduction of inserting fibres into the natural vegetation, it should also be apparent that the invention relates to a situation wherein a dike, which does not (yet) have natural vegetation, is first provided with the fibres, after which the natural vegetation will form only later around the inserted fibres.

The present inventors have established that the substrate obtained with the present method has the particular consequence of creating a digging/nesting location unattractive to moles and mice.

The invention will be elucidated hereinbelow on the basis of several examples and associated figures, which must not however be deemed as limitative of the scope of protection.

The same reference numerals are applied in the enclosed figures for corresponding elements.

Figure 1:
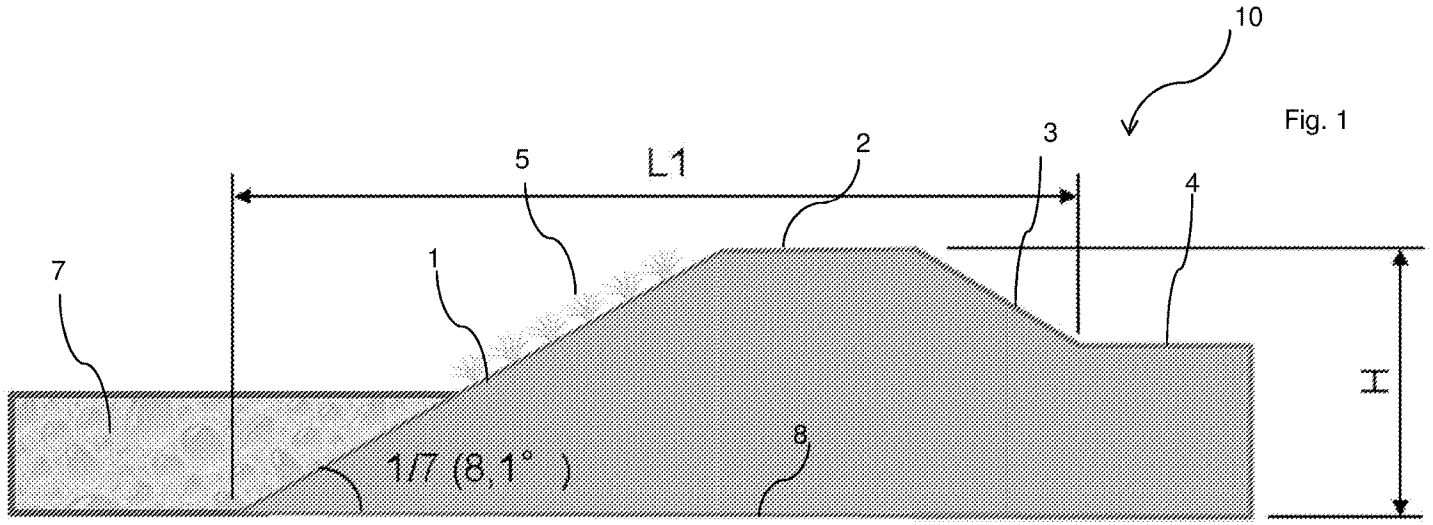
FIG. 1 shows a situation of an existing dike.

FIG. 1 shows a situation of an existing dike 10, comprising an inner slope 3, a crown 2 and an outer slope 1, wherein the outer slope 1 is located on the waterside 7. The outer slope 1 is provided with natural vegetation 5. Although natural vegetation 5 is shown only for the outer slope 1 in this figure, said vegetation can also be present on the inner slope 3 and crown 2. In accordance with general guidelines for such a dike 10, a maximum incline of for instance 1/7 is allowed, this incline being defined as the angle between the outer slope 1 and the horizontal 8. The area indicated with reference numeral 4 can be seen as land protected by the dike 10.

Figure 2:
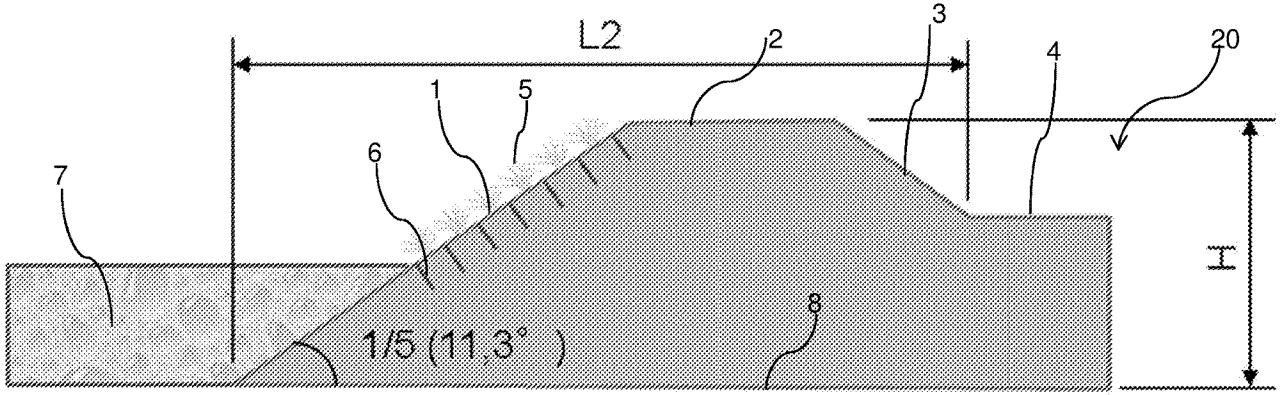
FIG. 2 shows an embodiment of the present invention.

Shown in FIG. 2 is an embodiment of the present invention wherein the dike 20 is provided with an outer slope 1 into which fibres 6 have been inserted. Such fibres 6 result in a reinforcement of the dike 20. Because of the presence of said fibres 6 in the outer slope 1 it is assumed that the dike 20 can be constructed with an incline greater than the incline as discussed in FIG. 1. The maximum incline applicable for the dike 20 amounts to for instance 1/5. The advantage of such a steeper incline of the dike 20 is that the length L2 as shown in FIG. 2 is shorter than the length L1 as shown in FIG. 1. This means that at an identical height, i.e. the height H is equal in both FIGS. 1 and 2, the dike 20 (FIG. 2) will take up less space than the dike 10. An advantage hereof is that costly compulsory purchase procedures will not have to be followed for land lying behind the dike. It should be noted that the values for the dike angle serve here solely by way of illustration.

Figure 3:
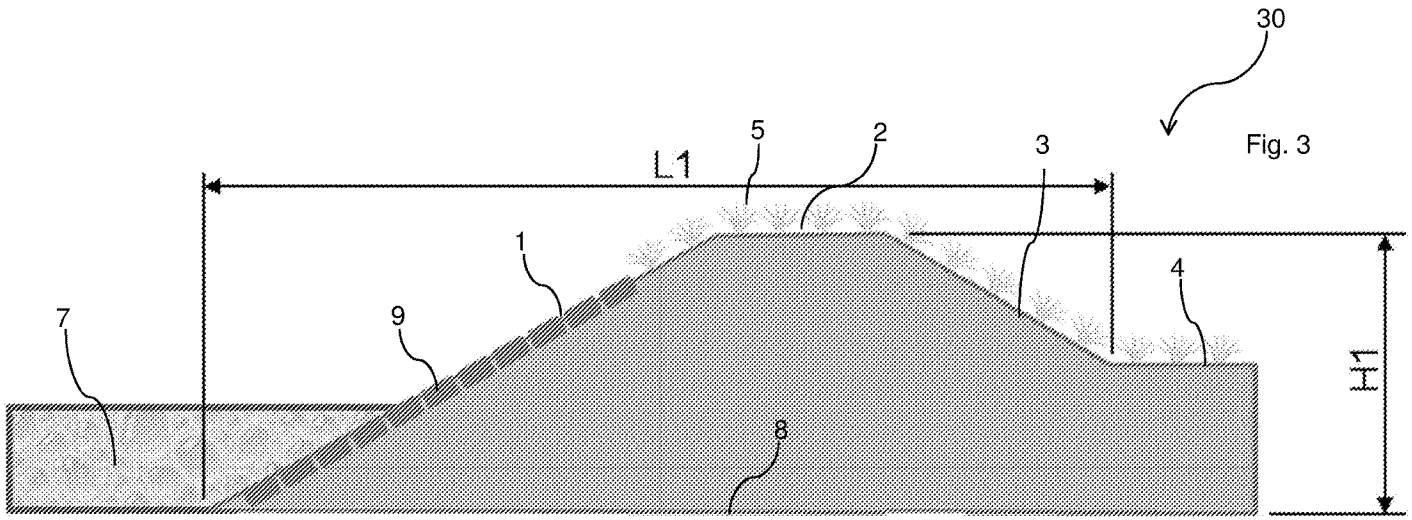
FIG. 3 shows a situation of an existing dike.

FIG. 3 shows a situation of an existing dike 30 wherein natural vegetation 5 is present on the inner slope 3, crown 2 and outer slope 1. Because of the force of the waves coming from the waterside 7 the outer slope 1 is provided with usual reinforcing means 9, for instance rocks, bitumen, geotextile materials. It is estimated in practice that the natural vegetation 5 can withstand 10 L/s wave overtopping.

Figure 4:
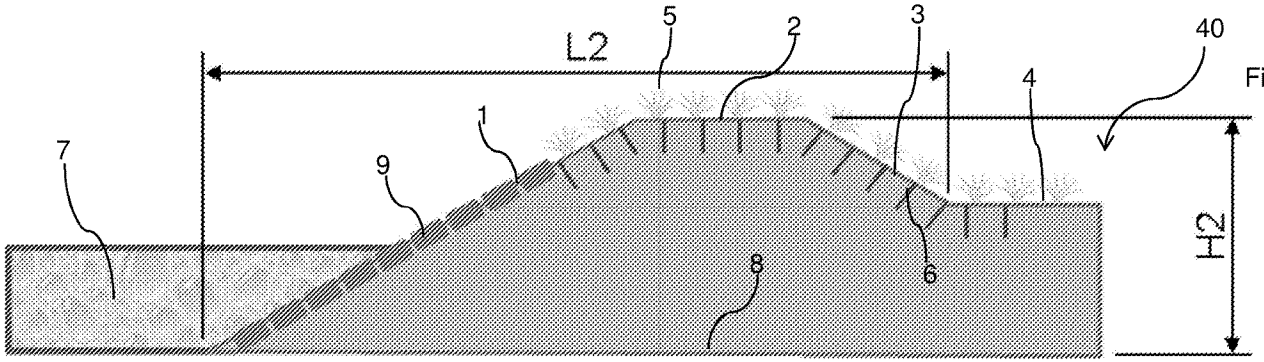
FIG. 4 shows another embodiment of the present invention.

Said value of 10 L/s can favourably be increased when the dike is provided with fibres inserted therein. Such a situation is shown schematically in FIG. 4, wherein fibres 6 are located in the dike 40 in the inner slope 3, crown 2 and outer slope 1. A part of the land 4 is also provided with fibres 6. It is assumed that the presence of said fibres can increase the value for the wave overtopping to 30-50 L/s. In such an embodiment there is less necessity to increase the height of the dike, wherein it is also the case that L2<L1, in particular H2<H1.

The invention claimed is:

1. A water barrier, comprising an inner slope, a crown and an outer slope, wherein the outer slope is located on the waterside, characterized in that a natural vegetation of at least one of the elements of inner slope, crown and outer slope is provided with fibers inserted into said vegetation, characterized in that said fibers are arranged in mutually adjacent rows, wherein the distance between the rows lies in the range of 10-50 mm, and wherein the mutual distance between fibers in a row amounts to 10-50 mm, characterized in that the mutually adjacent rows are offset from each other so that the fibers are placed at the corner points of an imaginary equilateral triangle with sides of 10-50 mm.

2. The water barrier according to claim 1, characterized in that at least two of the elements of inner slope, crown and outer slope are provided with fibers inserted into said vegetation.

3. The water barrier according to claim 1, characterized in that the fibers inserted into said vegetation are located under the surface of said vegetation.

4. The water barrier according to claim 1, characterized in that the fibers inserted into said vegetation extend to some extent above the surface of said vegetation.

5. The water barrier according to claim 1, characterized in that said fibers enclose an angle with at least one of the inner slope and outer slope, which angle amounts to less than 90°, preferably between 20° and 80°.

6. The water barrier according to claim 1, characterized in that said fibers are inserted to a depth of at least 10 cm, preferably at least 20 cm.

7. The water barrier according to claim 1, characterized in that the distance between rows of fibers arranged in said outer slope differs from the distance between rows of fibers arranged in said inner slope.

8. The water barrier according to claim 1, characterized in that the rows of fibers arranged in at least one of inner slope, crown and outer slope are not spaced homogeneously.

9. A method for manufacturing a water barrier as specified in claim 1, characterized in that one or more fibres are inserted into the natural vegetation of at least one of the elements of inner slope, crown and outer slope, characterized in that the insertion of said fibres takes place by means of injection, wherein a pin is positioned in the natural vegetation while carrying along a fibre, after which said pin is taken out of said vegetation while leaving said fibre behind in said vegetation.

10. The method according to claim 9, characterized in that the insertion of said fibres takes place by forming an opening in said vegetation, after which the fibre is inserted into the thus formed opening, characterized in that the forming of the opening takes place by means of a water jet and/or compressed air, characterized in that the forming of the opening takes place by means of a drill.

11. The method for manufacturing a water barrier according to claim 9, characterized in that a pin movable up and downward in a substantially vertical direction in the substrate is applied for arranging the fibres in the natural vegetation, wherein the method comprises the following steps of:

i) providing an endless fibre, ii) connecting an outer end of said pin to the fibre as according to i), iii) moving the outer end of said pin connected to the fibre as according to ii) in vertical direction to a desired depth in the substrate, iv) removing said pin from the substrate while leaving the fibre behind in the substrate, v) connecting an outer end of said pin once again to the fibre as according to i), vi) moving the outer end of said pin connected to the fibre as according to v) in vertical direction to a desired depth in the substrate, wherein the position of the fibre arranged in the substrate as according to iii) differs from the position of the fibre arranged in the substrate as according to vi).

12. The method according to claim 11, characterized in that between step iv) and step v) a step of severing the fibre is not performed.

13. The method according to claim 11, characterized in that steps ii)-vi) are repeated such that the thus obtained positions of fibres arranged in the substrate can be deemed a row of fibres.

14. The method according to claim 11, characterized in that steps ii)-vi) are repeated such that rows of fibres arranged in the substrate are obtained which are positioned regularly spaced from each other, wherein the rows of fibres arranged in the substrate positioned regularly spaced from each other are displaced relative to each other.

15. The method according to claim 11, characterized in that the fibre lying between fibres successively arranged vertically in the substrate lies against the upper surface of the substrate.

16. The method according to claim 15, characterized in that during at least one of the steps ii)-vi) a pressing member is applied in order to press the fibre lying against the upper surface against the upper surface.

17. The method according to claim 16, characterized in that the pressing member is a pressure roller moving over the upper surface.

18. The method according to claim 11, characterized in that during the repeated application of steps ii)-vi) the fibre is held under tension.

19. The method according to claim 11, characterized in that in order to improve the anchoring of the fibres arranged vertically in the substrate a mesh is applied, which mesh is positioned on the upper surface and connected to the fibres such that the fibres lying against the upper surface of the substrate enclose said mesh.

* * * * *